US006003440A

United States Patent [19]

Koskinen et al.

[11] Patent Number: 6,003,440

[45] Date of Patent: Dec. 21, 1999

[54] METHOD OF CALENDERING A PAPER WEB OR EQUIVALENT

[75] Inventors: Jukka Koskinen, Järvenpää; Markku Kyytsönen; Vilho Nissinen, both of Numminen, all of Finland

[73] Assignee: Valmet Corporation, Helsinki, Finland

[21] Appl. No.: 09/125,768

[22] PCT Filed: Feb. 18, 1997

[86] PCT No.: PCT/FI97/00100

§ 371 Date: Nov. 2, 1998

§ 102(e) Date: Nov. 2, 1998

[87] PCT Pub. No.: WO97/31150

PCT Pub. Date: Aug. 28, 1997

[30] Foreign Application Priority Data

Feb. 23, 1996 [FI] Finland ..... 960821

[51] Int. Cl.[6] ..... D21G 1/00

[52] U.S. Cl. ..... 100/35; 100/75; 100/162 R; 100/166; 100/172; 162/205

[58] Field of Search ..... 100/35, 43, 47, 100/74, 75, 161, 162 R, 163 R, 163 A, 166, 172; 162/205

[56] References Cited

U.S. PATENT DOCUMENTS

| | | | |
|---|---|---|---|
| 2,300,994 | 11/1942 | Thiele et al. | 100/163 A |
| 2,578,594 | 12/1951 | Putnam | 100/166 |
| 3,270,664 | 9/1966 | Veneman et al. | 100/162 R |
| 4,332,191 | 6/1982 | Kankaanpaa . | |
| 4,375,188 | 3/1983 | Leivskä . | |
| 4,497,246 | 2/1985 | Pav et al. | 100/162 R |
| 4,960,046 | 10/1990 | Anstötz et al. . | |
| 5,416,980 | 5/1995 | Ilvespää . | |

FOREIGN PATENT DOCUMENTS

| | | | |
|---|---|---|---|
| 62874 | 4/1981 | Finland . | |
| 65106 | 12/1989 | Finland . | |
| 892935 | 12/1989 | Finland . | |
| 91900 | 6/1992 | Finland . | |
| 2627272 | 12/1977 | Germany | 100/163 R |
| 29504024 | 6/1995 | Germany . | |
| 1-162892 | 6/1989 | Japan | 100/161 |

OTHER PUBLICATIONS

Partial Translation of Paperi Ja Puu—Paper and Timber vol. 77/No. 5/1995 Effect of the tension profile of paper on runnability, p. 280, col. 3, third paragraph—p. 281, col. 1, first paragraph.

*Primary Examiner*—Stephen F. Gerrity
*Attorney, Agent, or Firm*—Steinberg & Raskin, P.C.

[57] ABSTRACT

A method for calendering a web such as a paper web in a multi-nip calender or supercalender, in which the web is passed through calendering nips formed by rolls placed in two or more stacks of rolls. The web is passed alternatingly from the corresponding calendering nip in each stack of rolls into the calendering nip in the following stack of rolls. In other words, the web is passed from a first calendering nip in a first stack of rolls to a first calendering nip in a second stacks of rolls, after the first calendering nip in the second stack of rolls to a second calendering nip in the second stack of rolls, from the second calendering nip in the second stack of rolls to a second calendering nip in the first stack of rolls, and after the second calendering nip in the first stack of rolls to further processing.

19 Claims, 6 Drawing Sheets

METHOD OF CALENDERING A PAPER WEB OR EQUIVALENT

FIELD OF THE INVENTION

The invention concerns a method in calendering, in particular supercalendering, of a paper web or equivalent, in which method the paper web or equivalent is passed through the calendering nips formed by rolls for calendering of the paper web, in which method the rolls are placed in at least two stacks of rolls, in which method the paper web is passed from a corresponding calendering nip in each stack of rolls into a corresponding calendering nip in the next stack of rolls.

BACKGROUND OF THE INVENTION

As is well known, the set of rolls in a supercalender comprises a number of rolls, which have been arranged one above the other as a stack of rolls. The rolls placed one above the other are in nip contact with each other, and the paper web to be calendered is arranged to pass through the nips between the rolls. Supercalenders involve the drawback that in supercalenders the nips are loaded by the force of the weight of the set of rolls, in which case the distribution of the linear load from the upper nip to the lower nip is increasing in a substantially linear way. This has the consequence that the linear load present in the lower nip determines the loading capacity of the calender. Thus, the calender is dimensioned in compliance with the performance of the lowest rolls and, at the same time, some of the loading or calendering potential of the upper nips remains unused. Earlier, attempts have been made to solve this drawback related to the prior art so that attempts have been made to increase the deficient loading of the upper nips so that the supercalender is placed in the horizontal plane or that the stack of rolls in the calender is divided into two stacks of rolls. Such an embodiment has, however, also proved expensive, because a calender of two parts requires a higher number of adjustable-crown rolls. One embodiment in which the set of rolls in the calender has been divided into two stacks of rolls is described in the DE Utility Model Application No. 295 04 034.3. In this prior-art solution, in the calender divided in two stacks of rolls, the paper web is first passed through the calendering nips in one stack of rolls, and after that the paper web is passed into the other stack of rolls, in which the paper web is passed through its calendering nips.

In the way known from the prior art, in supercalenders, first one side, for example the top side, of the paper web has been calendered/glazed, and then the other side, for example the bottom side. In the prior-art solutions, a so-called reversing nip has determined where the side to be glazed is changed. In supercalenders, the glazing takes place most intensively in the first nips, in which case the glazing of the side that is glazed in the later nips to the same glaze level as is reached by the side glazed first requires, relatively speaking, higher linear loads, and this causes a higher loss of bulk in the web. Also, the difficult control of successive glazing often produces unequalsidedness in the paper glaze degree.

OBJECTS AND SUMMARY OF THE INVENTION

The object of the present invention is to provide a solution in which the problems related to unequalsidedness of glazing have been eliminated or at least minimnized.

In view of achieving the objectives stated above and those that will come out later, the method in accordance with the invention is mainly characterized in that, in the method, the paper web is passed from one stack of rolls into the next stack through a corresponding calendering nip in each stack of rolls until the web is passed from the last stack of rolls back through the following corresponding calendering nips from one stack of rolls into the next stack in the reversed sequence, and this is repeated until the paper web is passed from the last calendering nip to further processing.

According to the invention, the set of rolls in the supercalender has been divided into at least two stacks of rolls placed at a distance from one another, wherein the web runs from one stack of rolls into the next one until it is returned from the last stack of rolls through the other stacks of rolls into the first stack, etc. Thus, in the stacks of rolls in the calender, the web runs first through, for example, the first calendering nips in all the stacks of rolls and next through the second calendering nips in the reversed sequence until the web is passed from the last calendering nip to further processing, for example to reeling. This provides a number of advantages. In particular, the problems related to unequalsidedness of glazing are reduced remarkably and, moreover, the control of unequalsidedness is easier. Further, the solution in accordance with the invention provides savings in the bulk of the web, because the intensively loaded lower nips at the side that is to be glazed last are omitted and the glazing of both sides is started at the same time. By means of the present invention, a better glaze and smoothness are also obtained for the paper, and, moreover, it is possible to use lower linear loads, in which case the rolls have a longer service life and it is also possible to use higher running speeds. The arrangement in accordance with the invention does, in itself, not require a higher number of rolls than in the prior-art solutions, because by means of the mode of running in accordance with the invention and by means of the arrangement of regulation of the tension the same quality level is achieved with a lower number of nips than in the prior-art solutions.

According to the invention, the paper web can also be passed, in stead of being passed into the topmost calendering nip in a stack of rolls, for example, first into the lowest nip in the stack of rolls or even into the second nip from the top or from the bottom. The latter alternative is suitable for use, for example, when it is desirable, for example when the first treatment nip is at the top, to bring the bottom side of the web first into contact with a hot roll face and when, at the same time, it is desirable to use non-coated upper rolls only. In such a case, in the nip between the upper roll and the soft roll placed below it, no web runs at all. A similar situation can, of course, also arise when soft-coated upper/lower rolls only are used.

Also, a supercalender construction consisting of at least two stacks of rolls is of lower height, in which case an equally large space in the vertical direction is not needed as in the prior-art supercalender solutions. Nor is a reversing nip needed in the invention in order to reverse the other side of the web for glazing, but the rolls in the stacks of rolls have been arranged so that both sides of the web are glazed substantially at the same time.

According to the invention, for the control of the web tension between the stacks of rolls, for example, linear loads adjustable specifically for each nip are employed. The tensions and the differences in speed can also be controlled by choosing different roll hardnesses or roll materials or by using roll-specific drives.

For the control of the web tensions between stacks of rolls, it is also possible to utilize the stretch, in which the lag arising from slipping produces a slower surface speed of the upper rolls. The stretch arising from compression of paper compensates for the lag arising from slipping, and with a certain paper with a set of rolls of a certain sort the lag and the stretch are highly stable, i.e. the same paper can also be run through two separate equal sets of rolls.

For the control of web tensions, it is also possible to use nip-specific regulation of the linear load. For example, if a slack portion or an excessive tension tends to be formed in some gap between nips, the difference in draw over said gap can be changed by tightening or slackening the preceding or following nip. In the arrangement in accordance with the invention, it is also relatively easy to find a state of balance in which the tensions over all gaps are substantially equal, and in such a case the same glaze is obtained for both sides of the paper. The nip load, the roll hardness, and roll-specific drives, all of them affect the difference in speed between the rolls, in which connection all of these factors can be utilized for the control of the tensions between the stacks of rolls.

If necessary, the web tension can be measured between the stacks of rolls, and based on the measurement results it is possible to regulate the difference in speed.

Further, in the present invention, it is possible to take advantage of the fact that paper stretches when it becomes moist and shrinks when it becomes dry. In the present invention, this phenomenon is utilized in the control of the tension of the paper between the nips by regulating the moisture balance to such a level that the run of the web between the nips is controlled.

In a summarizing way, it can be stated that, in an arrangement in accordance with the present invention, the runnability is achieved so that a predetermined web tension is maintained by regulating the nip pressures specifically for each nip, for example, by means of relief devices or by in the sets of rolls placing self-loading rolls also in intermediate positions, by regulating the torques applied to the rolls through their drives or by regulating the surface speeds of the rolls, by regulating the temperature and/or moisture of the web, by regulating the surface temperature and/or the inside temperature in the rolls, and by regulating the temperature, pressure and humidity in the atmosphere surrounding the web. The predetermined web tension is maintained by choosing the properties of the roll coatings so that slipping between the rolls maintains the tensions of the web portions placed between the stacks of rolls.

In the arrangement in accordance with the invention, the calendering result is regulated first by regulating the properties of the web: glaze, thickness and smoothness, which are regulated by using the regulation parameters mentioned above in relation to the regulation of tension. Thus, in the regulation of the stacks of calender rolls, consideration is given, at the same time, both to control parameters related to the regulation of the web tension and to control parameters related to the web properties aimed at.

In the regulation of the regulation parameters, it is possible to use the following methods and devices. The web tension is regulated by means of empirical running parameters that have been stored in the memory specifically for each paper grade, or adaptively by means of devices of measurement of tension, of which devices can be mentioned tension measurement rolls, sets of rolls for tension measurement, measurement of tension by means of an air-cushion beam, measurement of tension as point measurement by means of an oscillating or static detector. Regulation of the roll and web speeds can be carried out based on measurement of surface speed, on measurement of speed of rotation of the rolls, or based on measurement of the flow in the roll drives. In the regulation of the roll temperatures, it is possible to use internal heat regulation methods, for example regulation of the heat transfer by a heating medium, for example regulation of the heat transfer by means of oil, water, steam, combustion gases, heating by means of an electric resistor, or inductive heating. In the regulation of the roll temperature, it is also possible to use external heat regulation methods, such as inductive heating, radiation heating and/or gas blowing.

In regulation of the temperature/heating capacity of the rolls, adaptive regulation connected with measurement of the properties of the web, adaptive regulation connected with measurement of the roll surface temperature, adaptive regulation connected with measurement of the temperature of the roll heat regulation medium, or adaptive regulation connected with measurement of the heating capacity of a roll is used.

The moisture and the temperature of the web can be regulated by adjusting the feed of steam onto the web, by regulating the feed of water mist onto the web, by means of drying/heating of the web produced by means of air blowing, by means of moistening taking place by means of a film transfer method, or by means of regulation of the atmosphere surrounding the web. Besides by the means mentioned above, the web temperature can also be regulated by means of heat regulation rolls and sets of belts, by means of sets of belts, by means of radiation heaters, and by means of regulation of the deflection angle of the web against the calender rolls.

According to the invention, the stacks of rolls used in calenders can be provided with most different combinations of rolls. Possible combinations include, for example, stacks of rolls in which all the rolls are provided with soft coatings, in which all the rolls are provided with hard faces, for example metal-faced or ceramic-faced rolls or equivalent, or in which some of the rolls are soft rolls and some of them hard rolls. As a special case can be mentioned a stack of rolls in which every other roll is soft and every other roll hard.

Further, in the stacks of rolls in a calender, all the rolls can be driven rolls, or only one roll is driven, as is known from conventional supercalenders. When the stacks of rolls are operated by means of one drive roll only, the location of the drive roll is chosen so that the slipping between said roll and the other stacks of rolls in the set of rolls maintains the tension of the web portions between the stacks of rolls and permits regulation of tension by means of other regulation parameters.

BRIEF DESCRIPTION OF THE DRAWINGS

In the following the invention will be described in more detail with reference to the figures in the accompanying drawing, in which.

DETAILED DESCRIPTION OF THE PREFERRED

Figure 1:
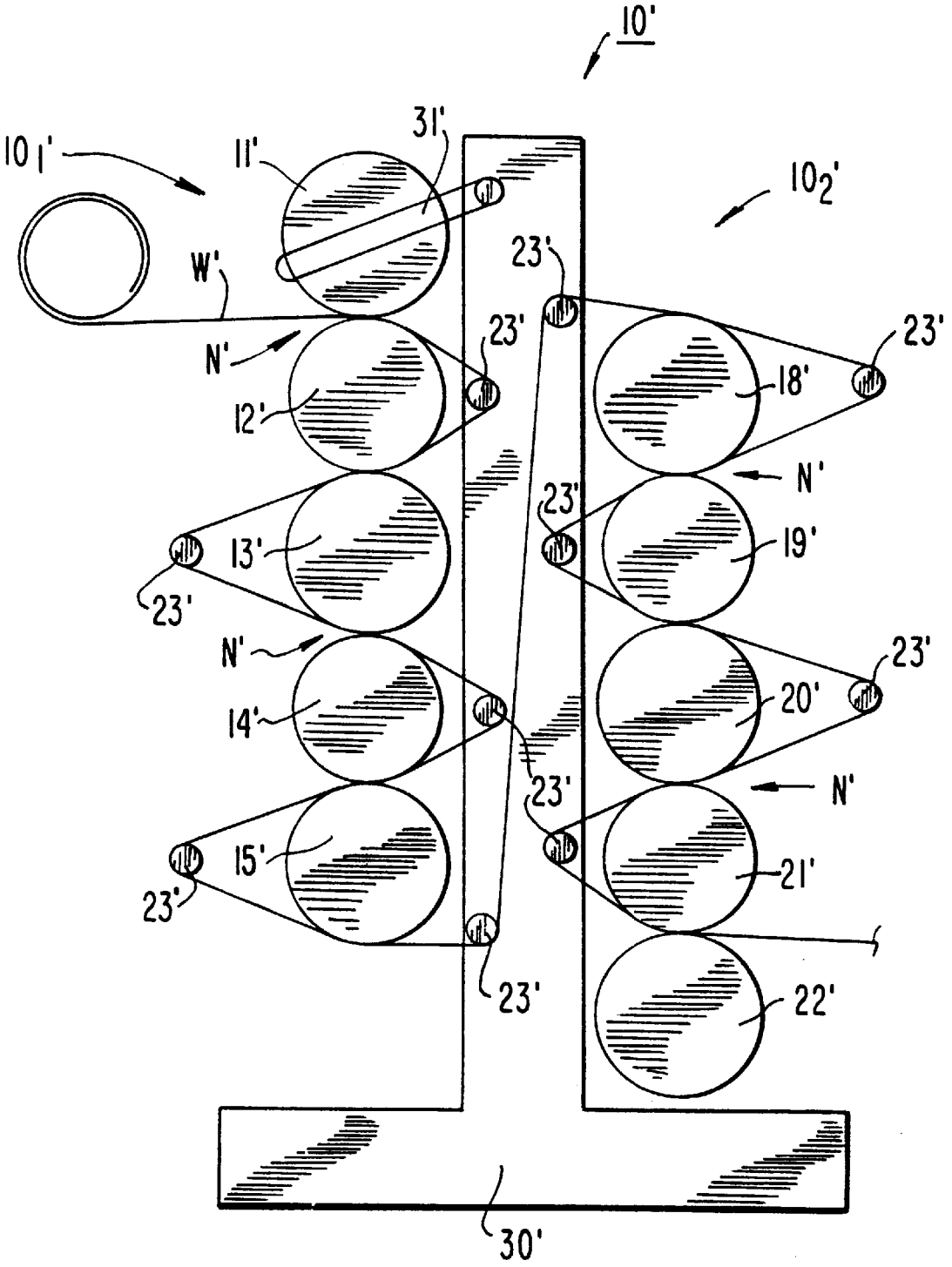
FIG. 1 PRIOR ART
FIG. 1 is a schematic illustration of a prior-art calender which consists of two stacks of rolls.

In the prior-art calender 10' shown in FIG. 1, the calender comprises two stacks $\mathbf{10_1}$',$\mathbf{10_2}$' of rolls, in which solution the paper web W' is first passed through the calendering nips N' in the first stack $\mathbf{10_1}$' of rolls and after that through the calendering nips N' in the second stack $\mathbf{10_2}$' of calendering rolls. The various rolls in the calender are denoted with the reference numerals 11',12',13',14',15',18',19',20', 21',22'. The guide rolls of the web are denoted with the reference numerals 23', and the frame constructions of the calender are shown in the figure schematically, and they are denoted with the reference numeral 30'.

Figure 2:
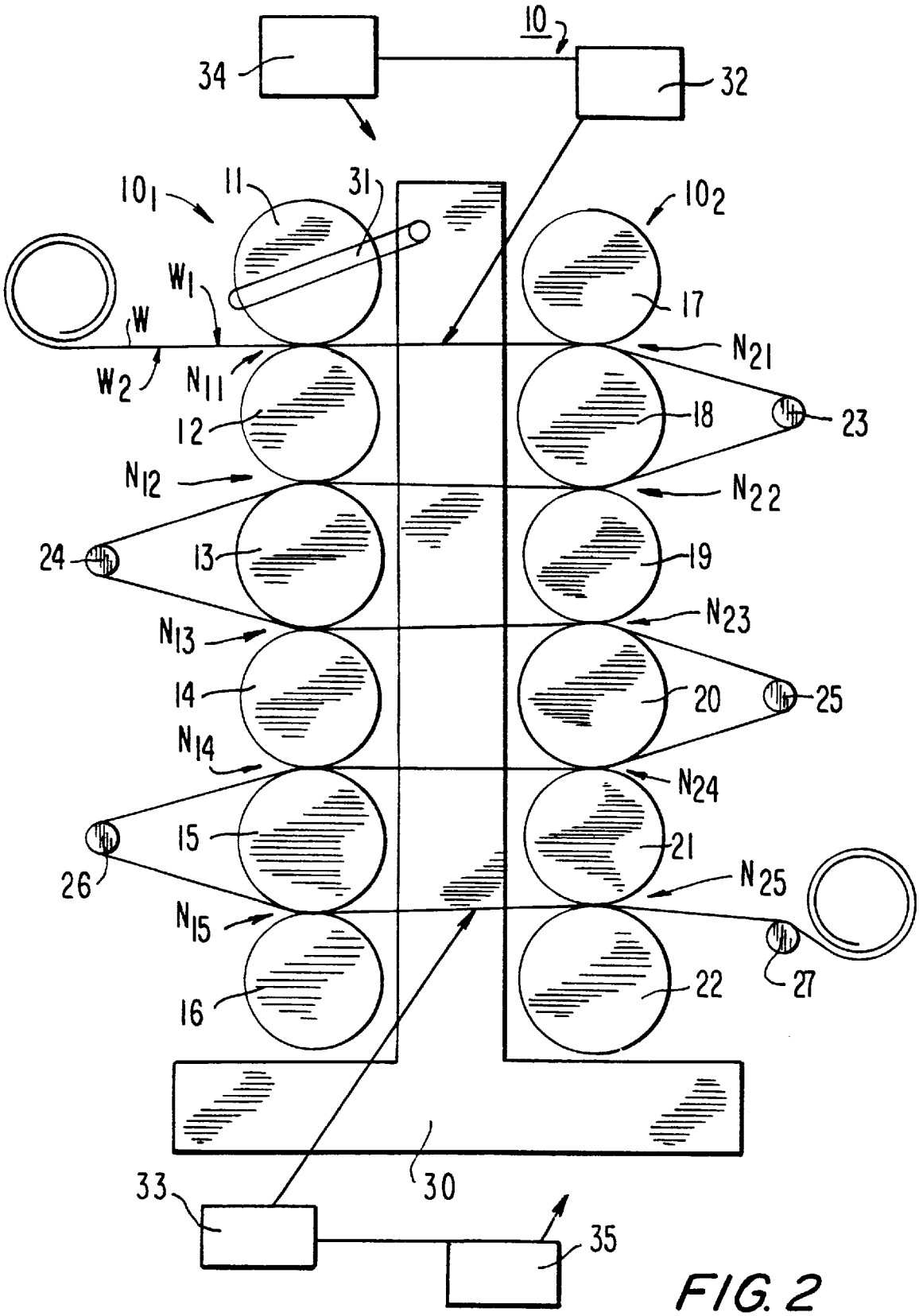
FIG. 2 is a schematic illustration of an exemplifying embodiment of a calender in accordance with the present invention.

In the embodiment of the invention shown in FIG. 2, the calender 10 comprises two stacks $\mathbf{10_1}$,$\mathbf{10_2}$ of rolls, and calender rolls 11,12,13,14,15,16;17,18,19,20,21,22 are fitted one above the other in each of said stacks. In the roll stack $\mathbf{10_1}$,$\mathbf{10_2}$, hard rolls 11,13,15;18,20,22 and soft rolls 12,14, 16;17,19,21 alternate, and the web W is passed to run alternatingly through the calendering nips $N_{12}$,$N_{13}$,$N_{14}$, $N_{15}$;$N_{21}$, $N_{22}$,$N_{23}$,$N_{24}$,$N_{25}$ in each stack $\mathbf{10_1}$;$\mathbf{10_2}$ of rolls so that different sides $W_1$,$W_2$ of the web W are glazed alternatingly.

As is shown in FIG. 2, the paper web W is passed through the nip $N_{11}$ between the hard roll 11 and the soft roll 12 in the first stack $\mathbf{10_1}$ of rolls and through the nip $N_{21}$ formed by the topmost soft roll 17 and the hard roll 18 in the second stack $\mathbf{10_2}$ of rolls onto the web guide roll 23, by whose means the web is reversed and passed through the second highest nip $N_{22}$ in the second stack $\mathbf{10_2}$ of rolls formed between the hard roll 18 and the soft roll 19 into the first stack $\mathbf{10_1}$ of rolls, in which the web W is passed through the second highest nip $N_{12}$ between the soft roll 12 and the hard roll 13 onto the web guide roll 24. In this way the paper web W runs from one stack of rolls into the other through the nips $N_{13}$,$N_{23}$,$N_{24}$,$N_{14}$,$N_{15}$,$N_{25}$ so that both sides $W_1$,$W_2$ of the web W are glazed alternatingly. The frame constructions of the calender 10 are illustrated in the figure just as a schematic construction 30. The drive arrangement of the roll 11 is illustrated as a schematic illustration 31. The tension of the paper web W can be measured in the area between the stacks $\mathbf{10_1}$,$\mathbf{10_2}$ of rolls, for example, by means of a measurement device 32,33, from which the measurement result is passed to the control and drive system 34,35 of the calender, which system 34,35 controls the operation of the calender, on the basis of the measurement result, so that the web tension is at the desired level.

Figure 3:
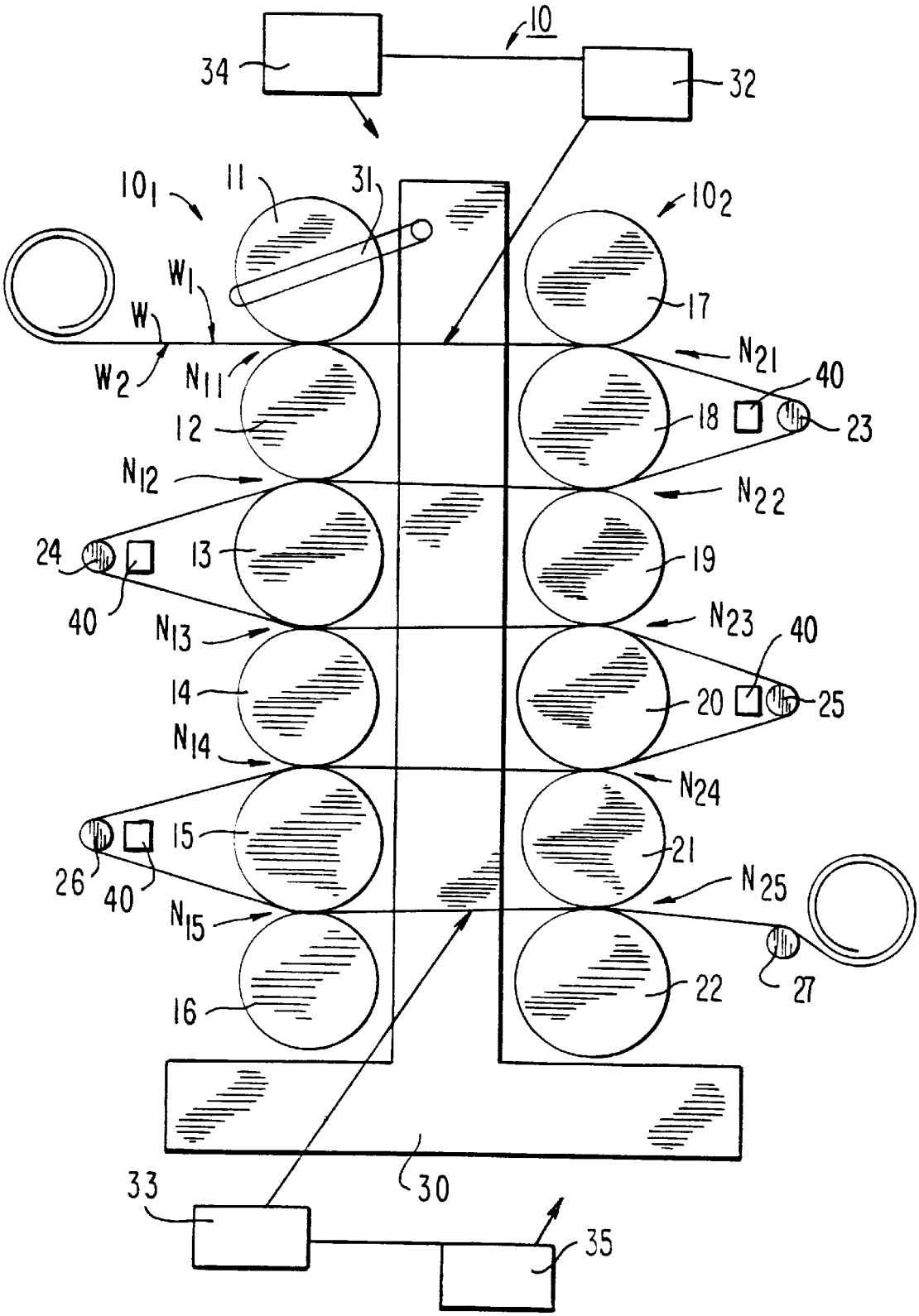
FIG. 3 is a schematic illustration of a second exemplifying embodiment of a calender in accordance with the present invention.

FIG. 3 is a schematic illustration of an exemplifying embodiment of the invention in which steam boxes 40 have been fitted in connection with each stack $\mathbf{10_1}$,$\mathbf{10_2}$ of rolls for moistening of the paper web W. In the other respects the exemplifying embodiment shown in FIG. 3 is similar to that shown in FIG. 2.

Figure 4:
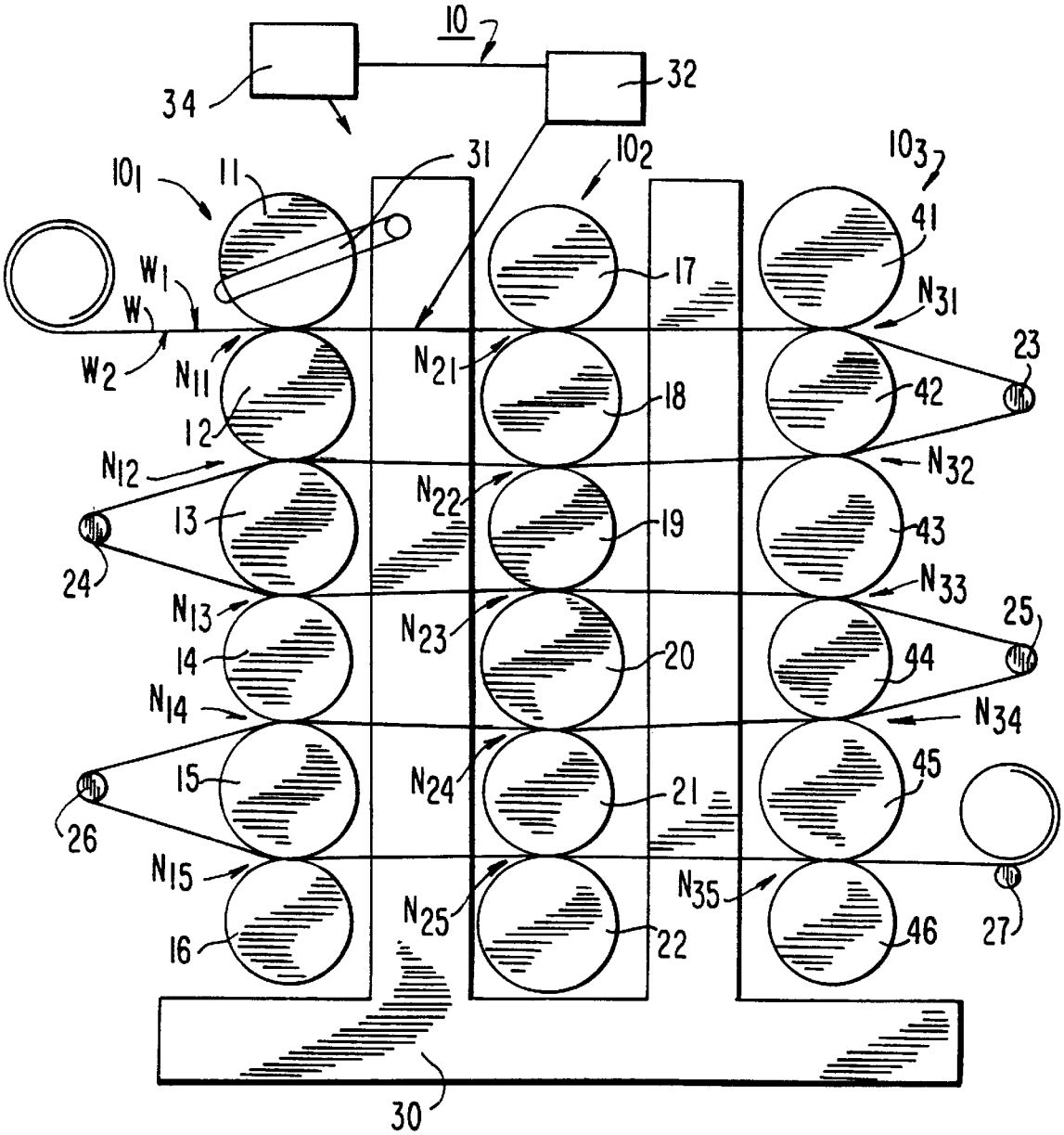
FIG. 4 is a schematic illustration of a third exemplifying embodiment of a calender in accordance with the present invention.

FIG. 4 shows an exemplifying embodiment of the invention in which the calender 10 is composed of three stacks $\mathbf{10_1}$,$\mathbf{10_2}$ and $\mathbf{10_3}$ of rolls. In the exemplifying embodiment shown in the figure the paper web W is first passed through the first calendering nip $N_{11}$,$N_{21}$,$N_{31}$ at the top of each stack $\mathbf{10_1}$,$\mathbf{10_2}$,$\mathbf{10_3}$ of rolls, after which the paper web W is passed over the guide roll 23 through the second calendering nip $N_{32}$,$N_{22}$,$N_{12}$ in each stack of rolls in the reversed sequence, and so forth, until the paper web W is passed through the last calendering nip $N_{35}$ to further processing. In the other respects the calender 10 is similar to the exemplifying embodiments shown in FIGS. 2 and 3, and corresponding parts are denoted with corresponding reference numerals. The calender rolls in the stack $\mathbf{10_1}$ of rolls in the calender 10 are denoted with the reference numerals 11,12,13,14,15,16, the calender rolls in the second stack $\mathbf{10_2}$ of rolls in the calender 10 are denoted with the reference numerals 17,18, 19,20,21 and 22, and the calender rolls in the third stack $\mathbf{10_3}$ of rolls are denoted with the reference numerals 41,42,43, 44,45 and 46. The frame constructions of the calender are denoted with the reference numeral 30, and the measurement, regulation and/or drive system of the calender with the reference numerals 32,34.

Figure 5A:
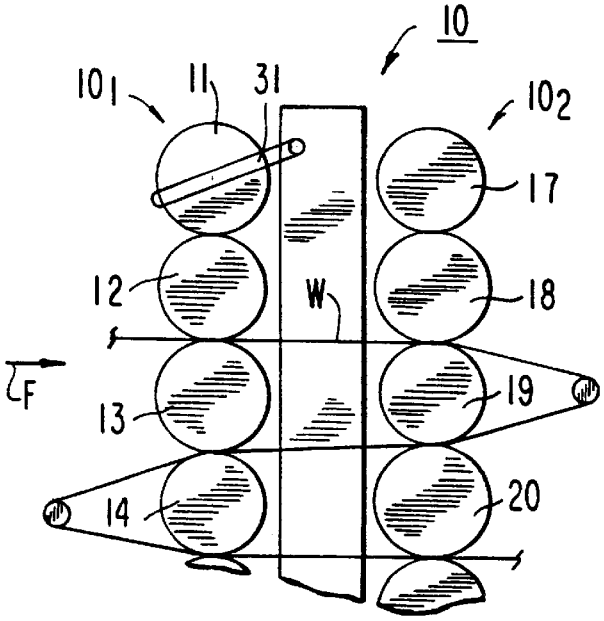
FIGS. 5A, 5B and 5C are schematic illustrations of some embodiments for passing the paper web through a calender consisting of two stacks of rolls.
Figure 5B:
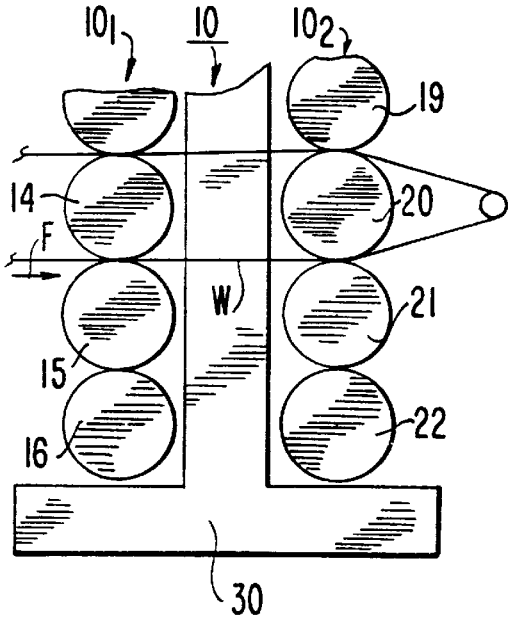
Figure 5C:
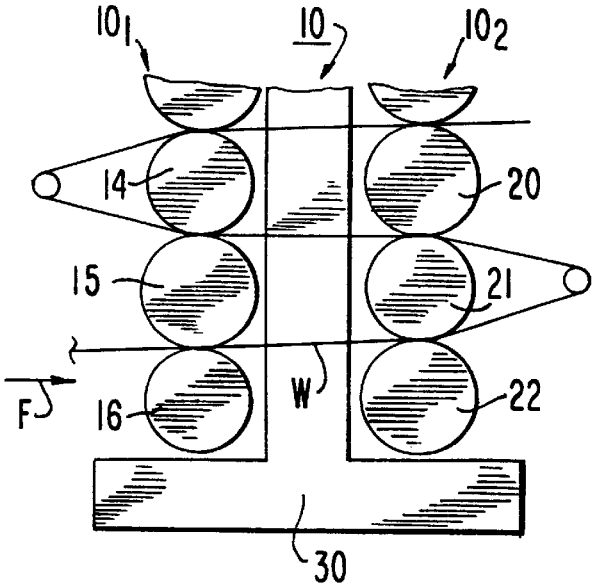

FIGS. 5A, 5B and 5C illustrate some applications for running the paper web W in a calender 10. The running direction of the paper web W is denoted with the arrow F, and the web W is passed alternatingly through the calendering nips in each stack $\mathbf{10_1}$,$\mathbf{10_2}$ of rolls.

In FIG. 5A the paper web W is passed into the second calendering nip, counted from the top, in the first stack $\mathbf{10_1}$ of rolls, which is formed between the rolls 12 and 13.

In FIG. 5B the paper web W is passed into the calender 10 first into the second calendering nip, counted from the bottom of the stack, in the first stack $\mathbf{10_1}$ of rolls, which nip is formed between the rolls 14 and 15.

In the exemplifying embodiment shown in FIG. 5C the paper web W is first passed into the lowest calendering nip in the first stack $\mathbf{10_1}$ of rolls, which nip is formed between the rolls 15 and 16.

Figure 6:
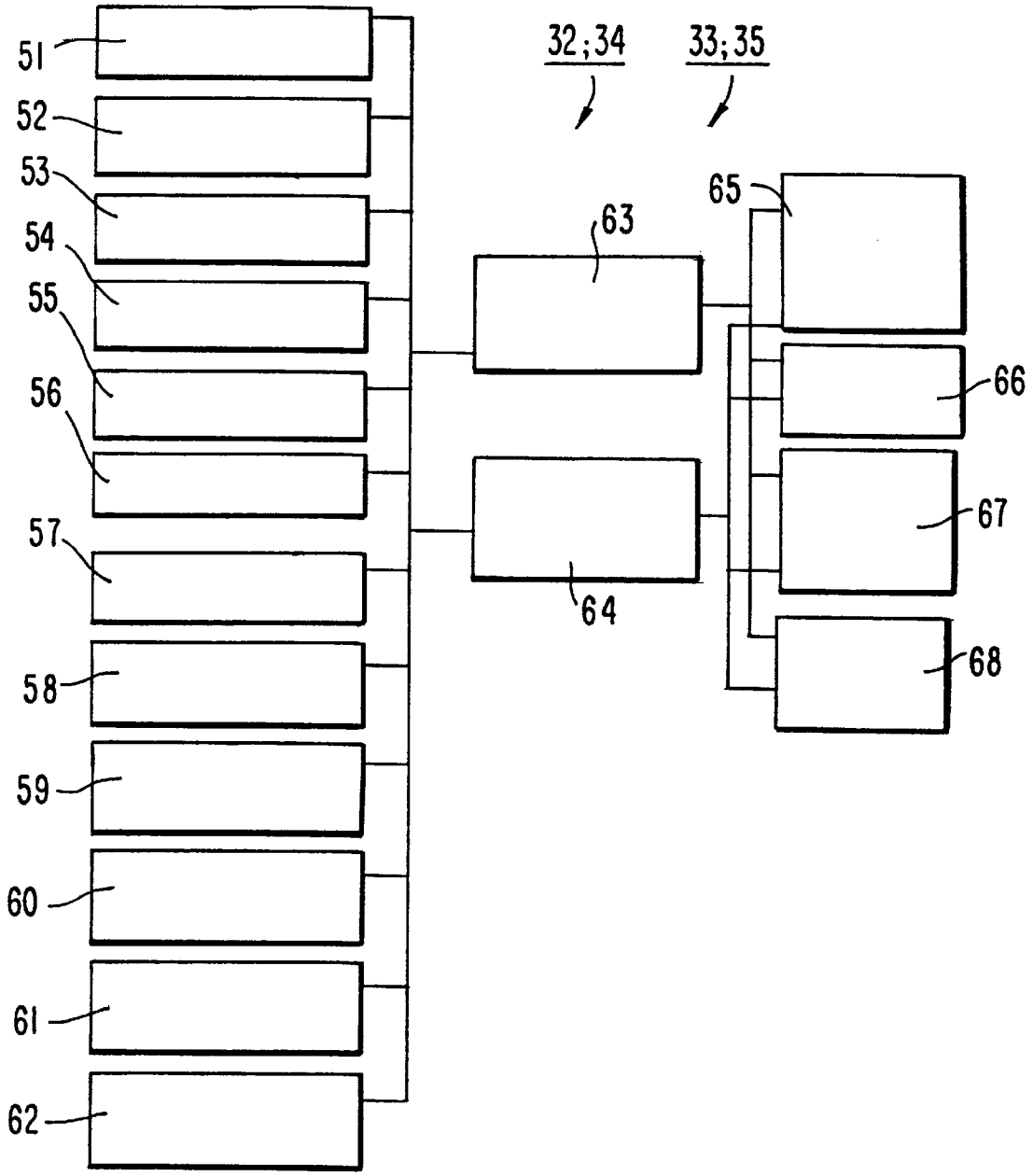
FIG. 6 shows a control block diagram for a calender of the present invention.

In the control diagram shown in FIG. 6, the control system consists of the following parts: paper tension measurement 51, paper moisture measurement 52, paper speed measurement 53, paper temperature measurement 54, paper thickness measurement 55, paper glaze measurement 56, roll speed measurement 57, roll surface temperature measurement 58, roll internal temperature measurement 59, measurement of heating capacity of rolls 60, measurement of drive capacity of rolls 61, measurement of drive torque of rolls 62, on the basis of which measurements the regulation values are determined by means of the paper-grade specific running parameters 63, and the regulation values are determined 64 by means of the mapped process, on whose basis the regulation 65 of the actuators that act upon the moisture of the paper, the regulation 67 of the drives, the regulation 67 of the properties of the atmosphere surrounding the paper, and the regulation 68 of the temperature of the rolls are obtained. For the control system, there can be a number of measurement points that is chosen freely based on the requirements and placed at suitable locations.

Above, the invention has been described with reference to some preferred exemplifying embodiments of same only, and the invention is by no means supposed to be strictly confined to the details of said embodiments. Many variations and modifications are possible within the scope of the inventive idea defined in the following patent claims.

We claim:

1. A method for calendering a web, comprising the steps of:

arranging rolls in at least two stacks and to define calendering nips between adjacent ones of the rolls in each of the at least two stacks of rolls, passing the web from a first one of the calendering nips in a first one of the at least two stacks of rolls to a first one of the calendering nips in a second one of the at least two stacks of rolls, passing the web after the first calendering nip in the second stack of rolls through a second one of the calendering nips in the second stack of rolls, passing the web from the second calendering nip in the second stack of rolls to a second one of the calendering nips in the first stack of rolls, passing the web after the second calendering nip in the first stack of rolls to further processing;

measuring tension of the web in runs between the first and second stacks of rolls, and utilizing the measured tension to regulate the calendering of the web in the calendering nips.

2. The method of claim 1, wherein the at least two stacks of rolls consists of only two stacks of rolls.

3. The method of claim 2, wherein the calendering nip in the first and second stacks of rolls are formed such that in each stack of rolls, a hard calender roll and a soft calender roll alternate whereby one side of the paper is glazed alternatingly.

4. The method of claim 2, further comprising the steps of:

passing the web from the second calendering nip in the first stack of roll to a third one of the calendering nips in the first stack of rolls, and passing the web from the third calendering nip in the first stack of rolls to a third one of the calendering nips in the second stack of rolls and then to further processing.

5. The method of claim 1, further comprising the step of:

constructing the rolls in the first and second stacks of rolls to have a certain hardness and be of a certain material to enable the web to have a desired tension.

6. The method of claim 1, further comprising the step of:

regulating tension of the web between the stacks of rolls by means of roll-specific drives.

7. The method of claim 1, further comprising the step of:

regulating tension of the web by using the stretch and compression of the web.

8. The method of claim 1, wherein each side of the web is calendered substantially simultaneously.

9. The method of claim 1, wherein in successively arranged ones of the calendering nips, a different side of the web is calendered.

10. The method of claim 1, wherein the at least two stacks of rolls comprises first, second and third stacks of rolls.

11. The method of claim 10, further comprising the steps of:

passing the web from the first calendering nip in the second stack of rolls to a first calendering nip in the third stack of rolls, passing the web from the first calendering nip in the third stack of rolls to a second one of the calendering nips in the third stack of rolls, and passing the web from the second calendering nip in the third stack of rolls to the second calendering nip in the second stack of rolls.

12. The method of claim 11, wherein the first calendering nip in the first, second and third stacks of rolls are positioned such that the web runs in a substantially horizontal path from the first calendering nip in the first stack of rolls to the first calendering nip in the second stack of rolls and from the first calendering nip in the second stack of rolls to the first calendering nip in the third stack of rolls.

13. The method of claim 11, wherein the first calendering nip in the first and second stacks of rolls are positioned such that the web runs in a substantially horizontal path from the first calendering nip in the first stack of rolls to the first calendering nip in the second stack of rolls.

14. The method of claim 1, wherein the first calendering nip in the first and second stacks of rolls is the uppermost calendering nip in the respective stack of rolls.

15. The method of claim 1, wherein the first calendering nip in the first and second stacks of rolls is the lowermost calendering nip in the respective stack of rolls.

16. The method of claim 1, wherein the first calendering nip in the first and second stacks of rolls is an intermediate calendering nip in the respective stack of rolls between the uppermost and lowermost calendering nips.

17. A method for calendering a web, comprising the steps of:

arranging rolls in at least two stacks and to define calendering nips between adjacent ones of the rolls in each of the at least two stacks of rolls, passing the web from a first one of the calendering nips in a first one of the at least two stacks of rolls to a first one of the calendering nips in a second one of the at least two stacks of rolls, passing the web after the first calendering nip in the second stack of rolls through a second one of the calendering nips in the second stack of rolls, passing the web from the second calendering nip in the second stack of rolls to a second one of the calendering nips in the first stack of rolls, passing the web after the second calendering nip in the first stack of rolls to further processing, and regulating tension of the web by regulating the linear load in at least one of the calendering nips in the first and second stacks of rolls.

18. A method for calendering a web, comprising the steps of:

arranging rolls in at least two stacks and to define calendering nips between adjacent ones of the rolls in each of the at least two stacks of rolls, passing the web from a first one of the calendering nips in a first one of the at least two stacks of rolls to a first one of the calendering nips in a second one of the at least two stacks of rolls, passing the web after the first calendering nip in the second stack of rolls through a second one of the calendering nips in the second stack of rolls, passing the web from the second calendering nip in the second stack of rolls to a second one of the calendering nips in the first stack of rolls, passing the web after the second calendering nip in the first stack of rolls to further processing, measuring a point between the first and second stacks of rolls at which tension of the web is changed, and changing the tension of the web by tightening or slackening the calendering nip preceding or following the point at which the change in the tension of the web is measured.

19. A method for calendering a web, comprising the steps of:

arranging rolls in at least two stacks and to define calendering nips between adjacent ones of the rolls in each of the at least two stacks of rolls, passing the web from a first one of the calendering nips in a first one of the at least two stacks of rolls to a first one of the calendering nips in a second one of the at least two stacks of rolls, passing the web after the first calendering nip in the second stack of rolls through a second one of the calendering nips in the second stack of rolls, passing the web from the second calendering nip in the second stack of rolls to a second one of the calendering nips in the first stack of rolls, passing the web after the second calendering nip in the first stack of rolls to further processing, and regulating tension of the web by regulating the moisture balance of the web.

* * * * *